US007689421B2

(12) United States Patent
Li et al.

(10) Patent No.: US 7,689,421 B2
(45) Date of Patent: Mar. 30, 2010

(54) VOICE PERSONA SERVICE FOR EMBEDDING TEXT-TO-SPEECH FEATURES INTO SOFTWARE PROGRAMS

(75) Inventors: Yusheng Li, Beijing (CN); Min Chu, Beijing (CN); Xin Zou, Beijing (CN); Frank Kao-ping Soong, Warren, NJ (US)

(73) Assignee: Microsoft Corporation, Redmond, WA (US)

( * ) Notice: Subject to any disclaimer, the term of this patent is extended or adjusted under 35 U.S.C. 154(b) by 380 days.

(21) Appl. No.: 11/823,169

(22) Filed: Jun. 27, 2007

(65) Prior Publication Data

US 2009/0006096 A1 Jan. 1, 2009

(51) Int. Cl.
*G10L 13/08* (2006.01)

(52) U.S. Cl. ..... 704/260; 704/266; 704/258

(58) Field of Classification Search ..... 704/258, 704/260, 268, 206, 275, 261, 266, 267, 243, 704/244, 270, 270.1
See application file for complete search history.

(56) References Cited

U.S. PATENT DOCUMENTS

| | | | | |
|---|---|---|---|---|
| 5,749,073 | A | 5/1998 | Slaney | |
| 6,226,614 | B1 * | 5/2001 | Mizuno et al. | 704/260 |
| 6,236,966 | B1 | 5/2001 | Fleming | |
| 6,792,407 | B2 | 9/2004 | Kibre et al. | |
| 6,895,084 | B1 | 5/2005 | Saylor et al. | |
| 6,961,704 | B1 * | 11/2005 | Phillips et al. | 704/268 |
| 6,985,865 | B1 * | 1/2006 | Packingham et al. | 704/275 |
| 7,016,848 | B2 | 3/2006 | St John Brittan et al. | |
| 7,117,159 | B1 | 10/2006 | Packingham et al. | |
| 7,269,561 | B2 * | 9/2007 | Mukhtar et al. | 704/270 |
| 2004/0006471 | A1 | 1/2004 | Chiu | |
| 2006/0031073 | A1 | 2/2006 | Anglin et al. | |
| 2006/0095265 | A1 | 5/2006 | Chu et al. | |
| 2006/0287865 | A1 | 12/2006 | Cross, Jr. et al. | |
| 2007/0174396 | A1 * | 7/2007 | Kumar et al. | 709/206 |

OTHER PUBLICATIONS

"A Survey of Existing Methods and Tools for Developing and Evaluation of Speech Synthesis and of Commercial Speech Synthesis Systems", http://www.disc2.dk/tools/SGsurvey.html, 2000.
Kehoe, et al., "Designing Help Topics for Use with Text-To-Speech", Date: 2006, pp. 157-163, ACM Press, NY, USA.
Orphanidou, Christina, "Voice Morphing", Date: 2001, pp. 1-52.

* cited by examiner

*Primary Examiner*—Huyen X. Vo

(57) ABSTRACT

Described is a voice persona service by which users convert text into speech waveforms, based on user-provided parameters and voice data from a service data store. The service may be remotely accessed, such as via the Internet. The user may provide text tagged with parameters, with the text sent to a text-to-speech engine along with base or custom voice data, and the resulting waveform morphed based on the tags. The user may also provide speech. Once created, a voice persona corresponding to the speech waveform may be persisted, exchanged, made public, shared and so forth. In one example, the voice persona service receives user input and parameters, and retrieves a base or custom voice that may be edited by the user via a morphing algorithm. The service outputs a waveform, such as a .wav file for embedding in a software program, and persists the voice persona corresponding to that waveform.

18 Claims, 6 Drawing Sheets

VOICE PERSONA SERVICE FOR EMBEDDING TEXT-TO-SPEECH FEATURES INTO SOFTWARE PROGRAMS

BACKGROUND

In recent years, the field of text-to-speech (TTS) conversion has been largely researched, with text-to-speech technology appearing in a number of commercial applications. Recent progress in unit-selection speech synthesis and Hidden Markov Model (HMM) speech synthesis has led to considerably more natural-sounding synthetic speech, which thus makes such speech suitable for many types of applications.

However, relatively few of these applications provide text-to-speech features. One of the barriers to popularizing text-to-speech in such applications is the technical difficulties in installing, maintaining and customizing a text-to-speech engine. For example, when a user wants to integrate text-to-speech into an application program, the user has to search among text-to-speech engine providers, pick one from the available choices, buy a copy of the software, and install it on possibly many machines. Not only does the user or his or her team have to understand the software, but the installing, maintaining and customizing of a text-to-speech engine can be a tedious and technically difficult process.

For example, in current text-to-speech applications, text-to-speech engines need to be installed locally, and require tedious and technically difficult customization. As a result, users are often frustrated when configuring different text-to-speech engines, especially when what many users typically want to do is only occasionally convert a small piece of text into speech.

Further, once a user has made a choice of a text-to-speech engine, the user has limited flexibility in choosing voices. It is not easy to obtain an additional voice unless without paying for additional development costs.

Still further, each multiple high quality text-to-speech voice requires a relatively large amount of storage, whereby the huge amount of storage needed to install multiple high quality text-to-speech voices is another barrier to wider adoption of text-to-speech technology. It is basically not possible for an individual user or small entity to have multiple text-to-speech engines with dozens or hundreds voices for use in applications.

SUMMARY

This Summary is provided to introduce a selection of representative concepts in a simplified form that are further described below in the Detailed Description. This Summary is not intended to identify key features or essential features of the claimed subject matter, nor is it intended to be used in any way that would limit the scope of the claimed subject matter.

Briefly, various aspects of the subject matter described herein are directed towards a technology by which a user-accessible service converts user input data to a speech waveform, based on user-provided input and parameter data, and voice data from a data store of voices. For example, the user may provide text tagged with parameter data, which is parsed such that the text is sent to a text-to-speech engine along with a selected base or custom voice data, and the resulting waveform morphed based on one or more tags, each tag accompanying a piece of text. The user may also provide speech. The service may be remotely accessible, such as by network/internet access, and/or by telephone mobile telephone systems.

Once created, data corresponding to the speech waveforms may be persisted in a data store of personal voice personas. For example, the speech waveform may be maintained in a personal voice persona comprising a collection of properties, such as in a name card. The personal voice persona may be shared, and may be used as the properties of an object.

In one example aspect, the voice persona service receives user input and parameter data, and retrieves a base voice or a custom voice based on the user input. The retrieved voice may be modified based on the user input and/or the parameter data, and the parameter data saved in a voice persona. The user may make changes to the parameter data in an editing operation, and/or may hear a playback of the speech while editing. The service may output a waveform corresponding to the voice persona, such as an audio (e.g., .wav) file for embedding in a software program, and/or may persist the voice persona corresponding to that waveform.

Other advantages may become apparent from the following detailed description when taken in conjunction with the drawings.

BRIEF DESCRIPTION OF THE DRAWINGS

The present invention is illustrated by way of example and not limited in the accompanying figures in which like reference numerals indicate similar elements and in which.

DETAILED DESCRIPTION

Various aspects of the technology described herein are generally directed towards an easily accessible voice persona platform, through which users can create new voice personas, apply voice personas in their applications or text, and share customization of new personas with others. As will be understood, the technology described herein facilitates text-to-speech with relatively little if any of the technical difficulties that are associated with installing and maintaining text-to-speech engines and voices.

To this end, there is provided a text-to-speech service through which users may voice-empower their applications or text content easily, through protocols for voice persona creation, implementation and sharing. Typical example scenarios for usage include creating podcasts by sending text with tags for desired voice personas to the text-to-speech service and getting back the corresponding speech waveforms, or converting a text-based greeting card to a voice greeting card.

Other aspects include creating voice personas by integrating text-to-speech technologies with voice morphing technologies such that, for example a base voice may be modified to have one of various emotions, have a local accent and/or have other acoustic effects.

While various examples herein are primarily directed to layered platform architectures, example interfaces, example effects, and so forth, it is understood that these are only examples. As such, the present invention is not limited to any particular embodiments, aspects, concepts, structures, functionalities or examples described herein. Rather, any of the embodiments, aspects, concepts, structures, functionalities or examples described herein are non-limiting, and the present invention may be used various ways that provide benefits and advantages in computing and speech technology in general.

Figure 1:
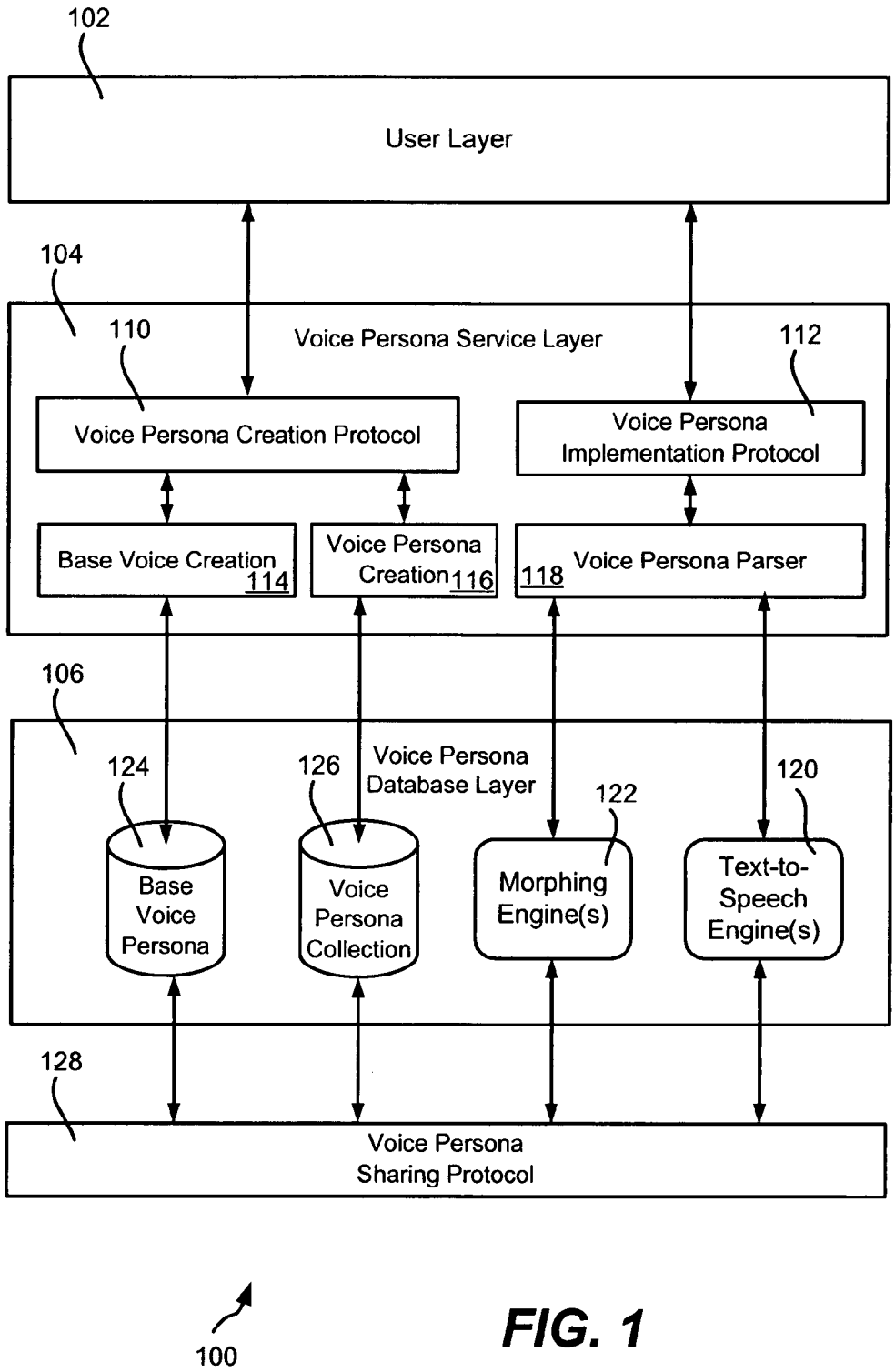
FIG. 1 is a block diagram representative of an example architecture of a voice persona platform.

Turning to FIG. 1, there is shown an example architecture of a voice persona platform 100. In this example implementation, there are three layers shown, namely a user layer 102, a voice persona service layer 104 and a voice persona database layer 106.

In general, the user layer 102 acts as a client customer of the voice persona service 104. The user layer 102 submits text-to-speech requests, such as by a web browser or a client application that runs in a local computing system or other device. As described below, the synthesized speech is transformed to the user layer 102.

The voice persona service layer 104 communicates with user layer clients via a voice persona creation protocol 110 and an implementation protocol 112, to carry out various processes as described below. Processes include base voice creation 114, voice persona creation 116 and parsing (parser 118). In general, the service integrates various text-to-speech systems and voices, for remote or local access through the Internet or other channels, such as a network, a telephone system, a mobile phone system, and/or a local application program. Users submit text embedded with tags to the voice persona service for assigning personas. The service converts the text to a speech waveform, which is downloadable to the users or can be streamed to an assigned application.

The voice persona database layer 106 manages and maintains text-to-speech engines 120, one or more voice morphing engines 122, a data store of base voices 124 and a data store of derived voice personas (voice persona collection) 126. The voice persona database layer 106 includes or is otherwise associated with a voice persona sharing protocol 128 through which users can share or trade personal/private voice personas.

As can be seen in this example, users can thus access the voice persona service layer 104 through three protocols for voice persona creation, implementation and sharing. The voice persona creation protocol 110 is used for creating new voice personas, and includes mechanisms for selecting base text-to-speech voices, applying a specific voice morphing effect or dialect. The creation protocol 110 also includes mechanisms to convert a set of user provided speech waveforms to a base text-to-speech voice. The voice persona implementation protocol comprises a main protocol for users to submit text-to-speech requests, in which users can assign voice personas to a specific piece of text. The voice persona sharing protocol 128 is used to maintain and manage voice persona data stores in the layer according to each user's specifications. In general, the sharing protocol is used to store, retrieve and update voice persona data in a secure, efficient and robust way.

Figure 2:
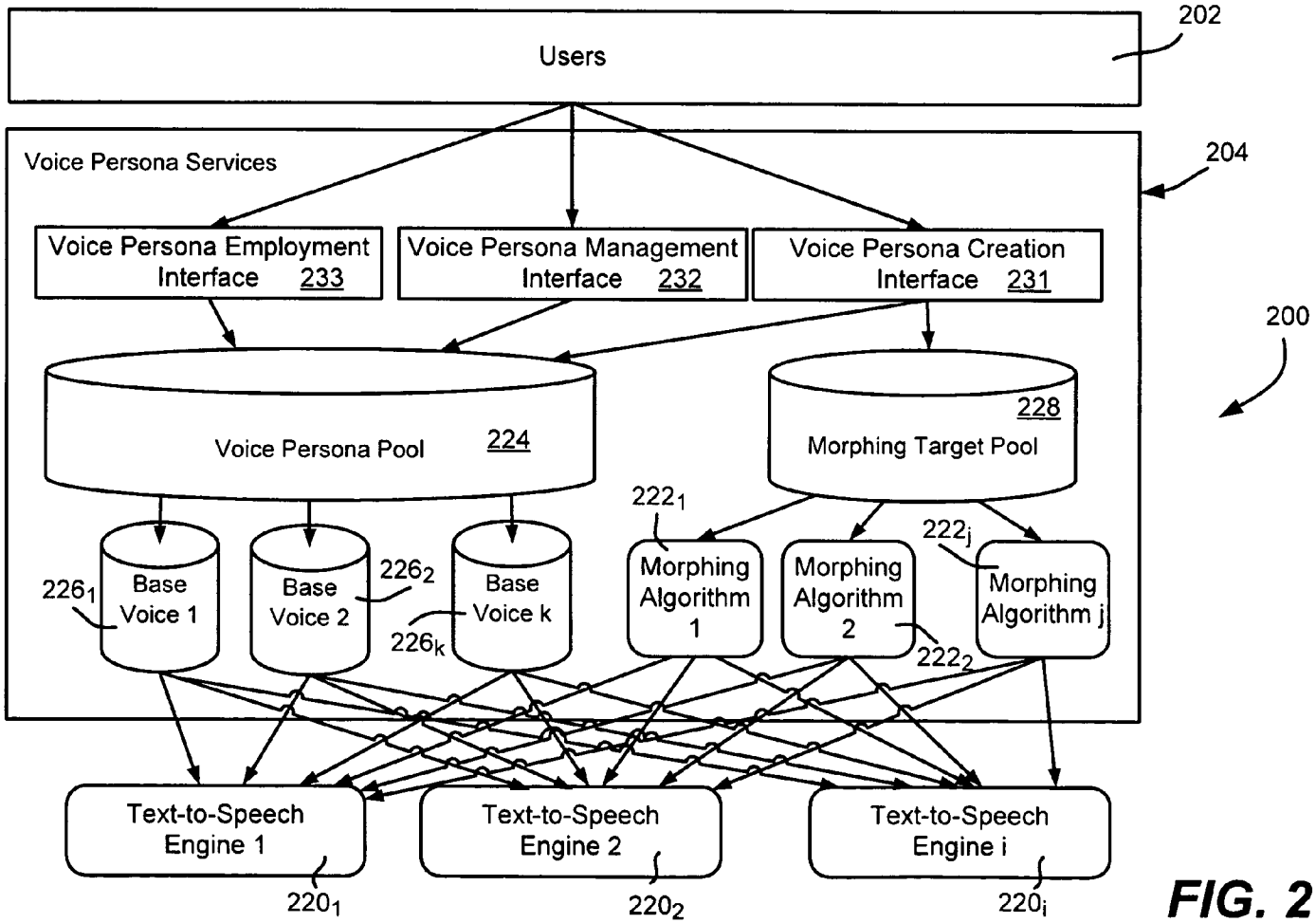
FIG. 2 is an alternative block diagram representative of an example architecture of a voice persona platform, suitable for internet access.

FIG. 2 represents a voice persona platform 200 showing alternatively represented components. As will be understood, FIG. 1 and FIG. 2 are not necessarily mutually exclusive platforms, but rather may be generally complementary in nature. The architecture/platform 200 allows adding new voices, new languages, and new text-to-speech engines.

As represented in the voice persona platform 200 of FIG. 2, multiple text-to-speech engines $\mathbf{220}_1$-$\mathbf{220}_i$ are installed. In general, most of such speech engines $\mathbf{220}_1$-$\mathbf{220}_i$ have multiple built-in voices and support some voice-morphing algorithms $\mathbf{222}_1$-$\mathbf{222}_j$. These resources are maintained and managed by a provider of the voice persona service 204, whereby users 202 are not involved in technical details such as choosing, installing, and maintaining text-to-speech engines, and thus not have to worry about how many text-to-speech engines are running, what morphing algorithms would be supported thereby, or the like. Instead, user-related operations are organized around a core object, namely the voice persona.

More particularly, in one implementation, a voice persona comprises an object having various properties. Example voice persona object properties may include a greeting sentence, a gender, an age range the object represents, the text-to-speech engine it uses, a language it speaks, a base voice from which the object is derived, supported morphing targets, which morphing target applied, the object's parent voice persona, its owner and popularity, and so forth. Each voice persona has a unique name, through which users can access it in an application. Some voice persona properties may be exposed to users, in what is referred to as a voice persona name card, to help identify a particular voice persona (e.g., the corresponding object's properties). For example, each persona has a name card to describe its origin, the algorithm and parameters for morphing effects, dialect effects and venue effects, the creators, popularity and so forth. A new voice persona may be derived from an existing one by inheriting main properties and overwriting some of them as desired.

As can be readily appreciated, treating a high-level persona concept as a management unit, such as in the form of a voice persona name card, hides complex text-to-speech technology details from customers. Further, configuring voice personas as individual units allows voice personas to be downloaded, transferred, traded, or exchanged as a form of property, like commercial goods.

Within the platform, there is a voice persona pool 224 that includes base voice personas 2261-226*k* to represent the base voices supported by the text-to-speech engines 2201-220*i*, and derived voice personas in a morphing target pool 228 that are created by applying a morphing target on a base voice persona.

In one example implementation, users will hear a synthetic example immediately after each change in morphing targets or parameters. Example morphing targets supported in one example voice persona platform are set forth below:

| Speaking style | Speaker | Accent from local dialect | Venue of speaking |
|---|---|---|---|
| Pitch level | Man-like | Ji'nan accent | Broadcast |
| Speech rate | Girl-like | Luoyang accent | Concert hall |
| Sound scared | Child-like | Xi'an accent | In valley |
| | Hoarse or Reedy | Southern accent | Under sea |
| | Bass-like | | |
| | Robot-like | | |
| | Foreigner-like | | |

As also shown in FIG. 2, users interact with the platform through three interfaces 231-233 designed for employing, creating and managing voice personas. In this manner, only the voice persona pool 224 and the morphing target pool 228 are exposed to users. Other resources including the text-to-speech engines $\mathbf{220}_1$-$\mathbf{220}_i$ and their voices are not directly accessible to users, and can only be accessed indirectly via voice personas.

Figure 3:
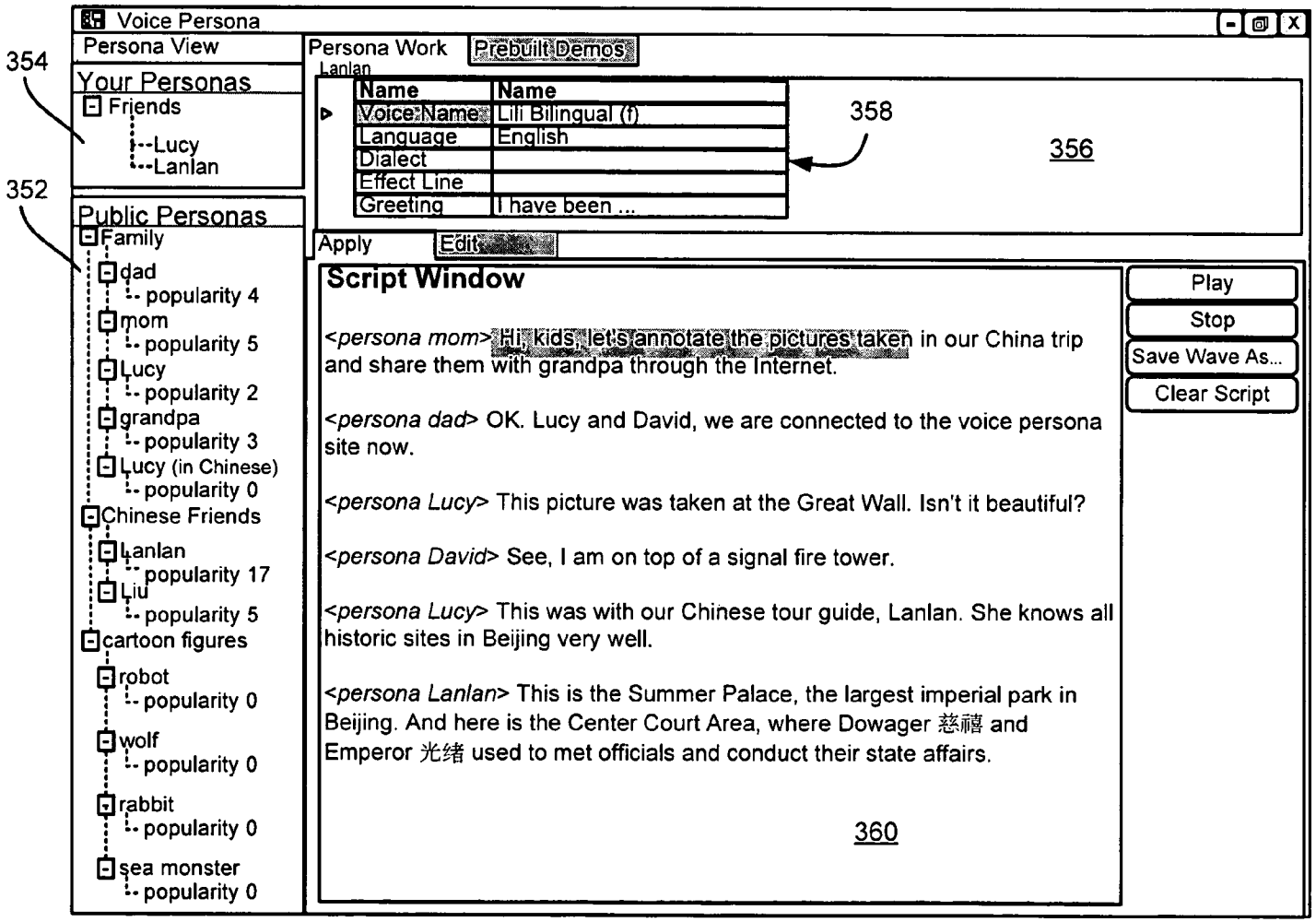
FIG. 3 is a visual representation of an example user interface for working with voice personas.

The voice persona creation interface 231 allows a user to create a voice persona. FIG. 3 shows an example of one voice persona creation user interface representation 350. The interface 350 includes a public voice persona list 352 and a private list 354. Users can browse or search the two lists, select a seed voice persona and make a clone of one under a new name. A top window 356 shows the name card 358 of the focused voice persona. Some properties in the view, such as gender and age range, can be directly modified by the creator, while others are overwritten through built-in functions. For example, when the user changes a morphing target, the corresponding field in the name card 358 is adjusted accordingly.

The large central window changes depending on the user selection of applying or editing, and as represented in this example comprises a set of scripts 360 (FIG. 3), or a morphing view 460 (FIG. 4) showing the morphing targets and pre-tuned parameter sets. In the morphing view, a user can choose one parameter set in one target, as well as clear the morphing setting. After the user finishes the configuration of a new voice persona, the name card's data is sent to the server for storage and the new voice persona is shown in the user's private view.

The voice persona employment interface 231 is straightforward for users. Users insert a voice persona name tag before the text they want spoken and the tag takes effect until the end of the text, unless another tag is encountered. To create a customized voice persona, users submit a certain amount of recorded speech with a corresponding text script, which is converted to a customized text-to-speech voice that the user may then use in an application or as other content. Example scripts for creating speech with voice personas are shown in the window 360 FIG. 3. After the tagged text is sent to the voice persona platform 200, the text is converted to speech with the appointed voice personas, and the waveform is delivered back to the user. This is provided along with additional information such as the phonetic transcription of the speech and the phone boundaries aligned to the speech waveforms if they are required. Such information can be used to drive lip-syncing of a "talking head" or to visualize the speech and script in speech learning applications.

After a user creates a new voice persona, the new voice persona is only accessible to the creator unless the creator decides to share it with others. Through the voice persona management interface 232, users can edit, group, delete, and share private voice personas. A user can also search for voice personas by their properties, such as all female voice personas, voice personas for teenagers or old men, and so forth.

Figure 4:
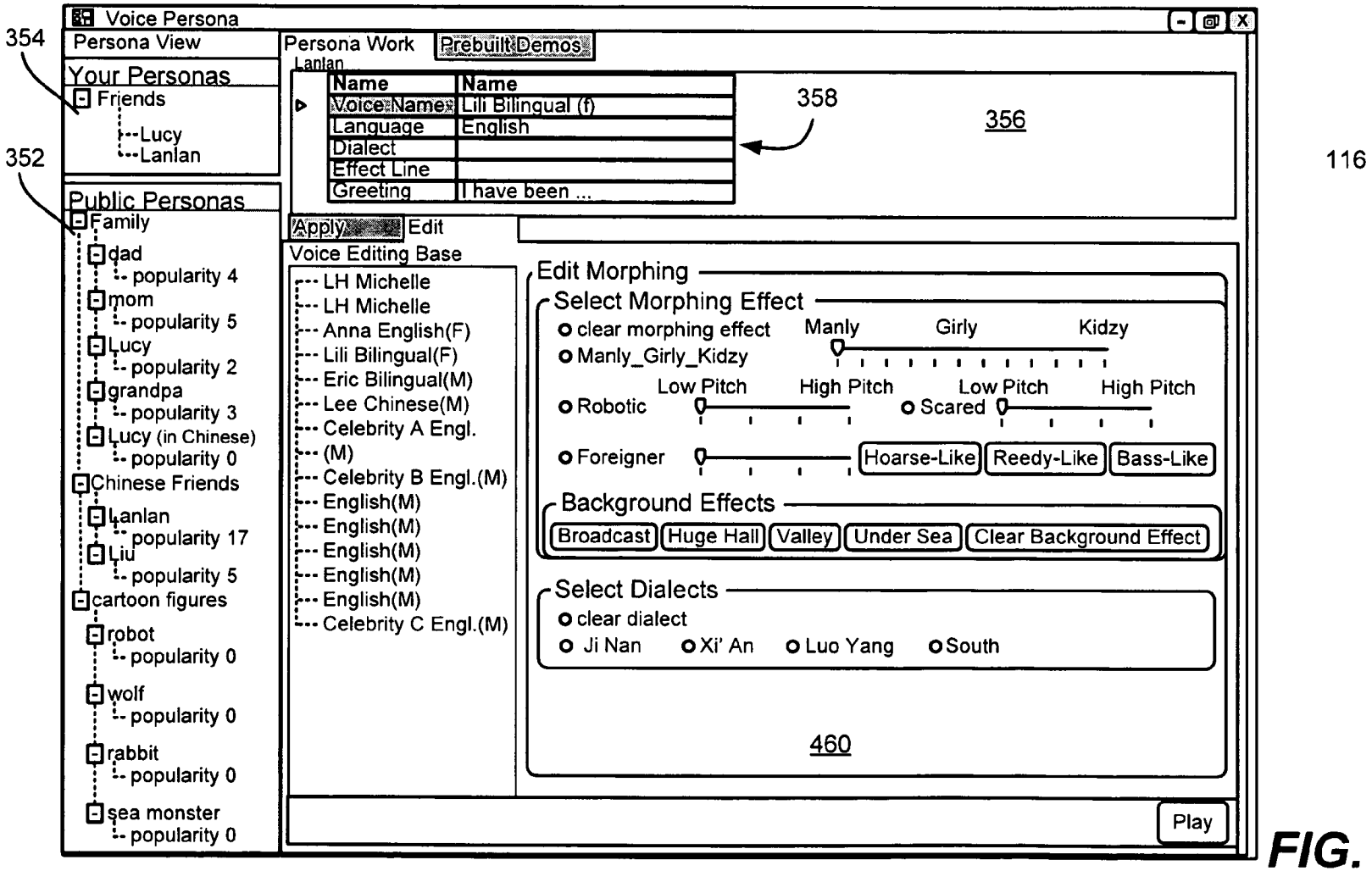
FIG. 4 is a visual representation of an example user interface for editing voice personas.

FIGS. 3 and 4 thus show examples of voice persona interfaces. In one example, when a user connects to the service 204, the user is presented with a set of public personas 330 (personas created and contributed by other users), as generally represented in FIG. 3. A user can create personas by selecting the basic voice 124 from a public voice data store. The user can use such personas to synthesize speech by entering scripts in the script window 360. In one implementation, the script window 360 uses XML-like tags to drive a voice persona engine. The final speech can be saved as a single audio (e.g., .wav) file, such as for podcasting purpose and so forth.

The user can tune the morphing parameters in the tuning panel 460 of FIG. 4, including by selecting different background effects and different dialect effects. The user can save and upload any such personal personas to the server, and can use these newly created personas in synthesizing scripts.

In one current example implementation of a voice persona platform, there are different text-to-speech engines installed. One is a unit selection-based system in which a sequence of waveform segments are selected from a large speech database by optimizing a cost function. These segments are then concatenated one-by-one to form a new utterance. The other is an HMM-based system in which context dependent phone HMMs have been pre-trained from a speech corpus. In the run-time system, trajectories of spectral parameters and prosodic features are first generated with constraints from statistical models and are then converted to a speech waveform.

In a unit-selection based text-to-speech system, the naturalness of synthetic speech depends to a great extent the goodness of the cost function as well as the quality of the unit inventory. Normally, the cost function contains two components, a target cost, which estimates the difference between a database unit and a target unit, and a concatenation cost, which measures the mismatch across the joint boundary of consecutive units. The total cost of a sequence of speech units is the sum of the target costs and the concatenation costs.

Acoustic measures, such as Mel Frequency Cepstrum Coefficients (MFCC), $f_0$, power and duration, may be used to measure the distance between two units of the same phonetic type. Units of the same phone are clustered by their acoustic similarity. The target cost for using a database unit in the given context is defined as the distance of the unit to its cluster center, i.e., the cluster center is believed to represent the target values of acoustic features in the context. With such a definition for target cost, there is a connotative assumption, namely for any given text, there always exists a best acoustic realization in speech. However, this is not true in human speech; even under highly restricted conditions, e.g., when the same speaker reads the same set of sentences under the same instruction, rather large variations are still observed in phrasing sentences as well as in forming $f_0$ contours. Therefore, in the unit-selection based text-to-speech system, no $f_0$ and duration targets are predicted for a given text. Instead, contextual features (such as word position within a phrase, syllable position within a word, Part-of-Speech (POS) of a word, and so forth) that have been used to predict $f_0$ and duration targets in other studies are used in calculating the target cost directly. The connotative assumption for this cost function is that speech units spoken in similar context are prosodically equivalent to one another in unit selection if there is a suitable description of the context.

Because in this unit-selection based speech system units are always joint at phone boundaries, which are the rapid change areas of spectral features, the distances between spectral features at the two sides of the joint boundary is not an optimal measure for the goodness of concatenation. A rather simple concatenation cost is that the continuity for splicing two segments is quantized into four levels: 1) continuous—if two tokens are continuous segments in the unit inventory, the target cost is set to 0; 2) semi-continuous—though two tokens are not continuous in the unit inventory, the discontinuity at their boundary is often not perceptible, like splicing of two voiceless segments (such as /s/+/t/), a small cost is assigned; 3) weakly discontinuous—discontinuity across the concatenation boundary is often perceptible, yet not very strong, like the splicing between a voiced segment and an unvoiced segment (such as /s/+/a:/) or vice versa, a moderate cost is used; 4) strongly discontinuous—the discontinuity across the splicing boundary is perceptible and annoying, like the splicing between voiced segments, a large cost is assigned. Types 1) and 2) are preferred in concatenation, with the fourth type avoided as much as possible.

With respect to unit inventory, a goal of unit selection is to find a sequence of speech units that minimize the overall cost. High-quality speech will be generated only when the cost of the selected unit sequence is low enough. In other words, only when the unit inventory is sufficiently large can there always be found a good enough unit sequence for a given text, otherwise natural sounding speech will not result. Therefore, a high-quality unit inventory is needed for unit-selection based text-to-speech systems.

The process of the collection and annotation of a speech corpus often requires human intervention such as manually checking or labeling. Creating a high-quality text-to-speech voice is not an easy task even for a professional team, which is why most state-of-the-art unit selection systems provide only a few voices. A uniform paradigm for creating multilingual text-to-speech voice databases with focuses on technologies that reduce the complexity and manual work load of the task has been proposed. With such a platform, adding new voices to a unit-selection based text-to-speech system becomes relatively easier. Many voices have been created from carefully designed and collected speech corpus (greater than ten hours of speech) as well as from some available audio resources such as audio books in the public domain. Further, several personalized voices are built from small, office recordings, such as hundreds or so carefully designed sentences read and recorded. Large footprint voices sound rather natural in most situations, while the small footprint ones sound acceptable only in specific domains.

One advantage of the unit selection-based approach is that all voices can reproduce the main characteristics of the original speakers, in both timber and speaking style. The disadvantages of such systems are that sentences containing unseen context sometimes have discontinuity problems, and these systems have less flexibility in changing speakers, speaking styles or emotions. The discontinuity problem becomes more severe when the unit inventory is small.

To achieve more flexibility in text-to-speech systems, an HMM-based approach may be used, in which speech waveforms are represented by a source-filter model. Excitation parameters and spectral parameters are modeled by context-dependent HMMs. The training process is similar to that in speech recognition, however a main difference is in the description of context. In speech recognition, normally only the phones immediately before and after the current phone are considered. However, in speech synthesis, any context feature that has been used in unit selection systems can be used. Further, a set of state duration models are trained to capture the temporal structure of speech. To handle problems due to a scarcity of data, a decision tree-based clustering method is applied to tie context dependent HMMs. During synthesis, a given text is first converted to a sequence of context-dependent units in the same way as it is done in a unit-selection system. Then, a sentence HMM is constructed by concatenating context-dependent unit models. Next, a sequence of speech parameters, including both spectral parameters and prosodic parameters, are generated by maximizing the output probability for the sentence HMM. Finally, these parameters are converted to a speech waveform through a source-filter synthesis model. Mel-cepstral coefficients may be used to represent speech spectrum. In one system, Line Spectrum Pair (LSP) coefficients are used.

Requirements for designing, collecting and labeling of speech corpus for training a HMM-based voice are similar to those for a unit-selection voice, except that the HMM voice can be trained from a relatively small corpus yet still maintain reasonably good quality. Therefore, speech corpuses used by the unit-selection system are also used to train HMM voices.

Speech generated with the HMM system is normally stable and smooth. The parametric representation of speech provides reasonable flexibility in modifying the speech. However, like other vocoded speech, speech generated from the HMM system often sounds buzzy. Thus, in some circumstances, unit selection is a better approach than HMM, while HMM is better in other circumstances. By providing both engines in the platform 200, users can decide what is better for a given circumstance.

Three voice-morphing algorithms $\mathbf{222}_1$-$\mathbf{222}_j$ are also represented in FIG. 2, although any practical number is feasible in the platform. For example, the voice-morphing algorithms $\mathbf{222}_1$-$\mathbf{222}_j$ may provide sinusoidal-model based morphing, source-filter model based morphing, and phonetic transition, respectively. Sinusoidal-model based morphing and source-filter model based morphing provide pitch, time and spectrum modifications, and are used by unit-selection based systems and HMM-based systems. Phonetic transition is designed for synthesis dialect accents with a standard voice in the unit selection-based system.

Sinusoidal-model based morphing achieves flexible pitch and spectrum modifications in a unit-selection based text-to-speech system. Thus, one such morphing algorithm is operated on the speech waveform generated by the text-to-speech system. Internally, the speech waveforms are converted into parameters through a Discrete Fourier Transforms. To avoid the difficulties in voice/non-voice detection and pitch tracking, a uniformed sinusoidal representation of speech, shown as in Eq. (1), is adopted.

$$S_i(n)\sum_{l=1}^{L_i} A_i \cdot \cos[\omega_l n + \theta_i] \tag{1}$$

where $A_l$, $\omega_l$ and $\theta_l$ are the amplitudes, frequencies and phases of the sinusoidal components of speech signal, and $S_i(n)$, $L_i$ is the number of components considered. These parameters are can be modified separately.

For pitch scaling, the central frequencies of the components are scaled up or down by the same factor simultaneously. Amplitudes of new components are sampled from the spectral envelop formed by interpolating $A_l$. Phrases are kept as before. For formant position adjustment, the spectral envelop is formed by interpolating between $A_l$ stretched or compressed toward the high-frequency end or the low-frequency end by a uniformed factor. With this method, the formant frequencies are increased or decreased together, but without adjusting the individual formant location. In the morphing algorithm, the phase of sinusoidal components can be set to random values to achieve whisper or hoarse speech. The amplitudes of even or odd components may be attenuated to achieve some special effects.

Proper combination of the modifications of different parameters will generate the desired style, speaker morphing targets set forth in the above example. For example, scaling up the pitch by a factor 1.2-1.5 and stretch the spectral envelop by a factor 1.05-1.2, causes a male voice to sound like a female. Scaling down the pitch and setting the random phase for all components provides a hoarse voice.

With respect to source-filter model based morphing, because in the HMM-based system, speech has been decomposed to excitation and spectral parameters, pitch scaling and formant adjustment is easy to achieve by directly adjusting the frequency of excitation or spectral parameters. The random phase and even/odd component attenuation are not supported in this algorithm. Most morphing targets in style morphing and speaker morphing can be achieved with this algorithm.

A key idea of phonetic transition is to synthesize closely-related dialects with the standard voice by mapping the phonetic transcription in the standard language to that in the target dialect. This approach is valid only when the target dialect shares a similar phonetic system with the standard language.

A rule-based mapping algorithm has been built to synthesize Ji'nan, Xi'an and Luoyang dialects in China with a Mandarin Chinese voice. It contains two parts, one for phone mapping, and the other for tone mapping. In an on-line system, the phonetic transition module is added after the text and prosody analysis. After the unit string in Mandarin is converted to a unit string representing the target dialect, the same unit selection is used to generate speech with the Mandarin unit inventory.

Figure 5:
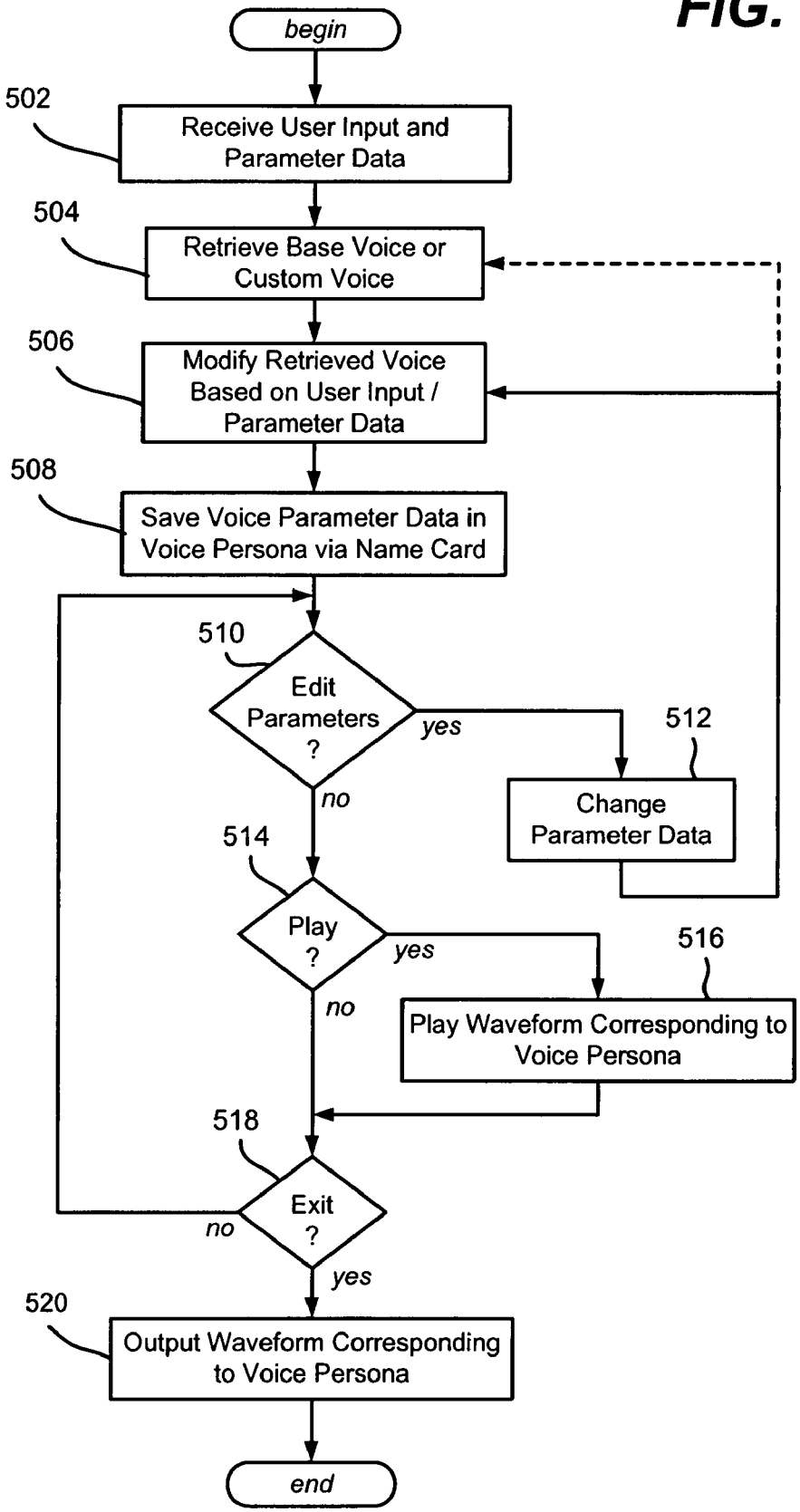
FIG. 5 is a flow diagram representing example steps that may be taken by a voice persona service to facilitate the embedding of text-to-speech into a software program.

By way of summary, FIG. 5 is a flow diagram representing some example steps that may be performed by a voice persona service such as exemplified in FIGS. 1-4. Step 502 represents receiving user input and parameter data, such as text (user- or script-supplied), a name, a base voice and parameters for modifying the base voice. Note that this may be during creation of a new persona from another public or private persona, or upon selection of a persona for editing.

Step 504 represents retrieving the base voice from the data store of base voices, or retrieving a custom voice from the data store of collected voice personas. Note that security and the like may be performed at this time to ensure that private voices may only be accessed by authorized users.

Step 506 represents modifying the retrieved voice as necessary based on the parameter data. For example, a user may provide new text to a custom voice or a base voice, may provide parameters to modify a base voice via morphing effects, and so forth as generally described above. Step 508 represents saving the changes; note that saving can be skipped unless and until changes are made, and further, the user can exit without saving changes, however such logic is omitted from FIG. 5 for purposes of brevity.

Steps 510 and 512 represent the user editing the parameters, such as by using sliders, buttons and so forth to modify settings and select effects and/or a dialect, such as in the example edit interface of FIG. 4. Note that step 512 is shown as looping back to step 506 to make the change, however the (dashed) line back to step 504 is a feasible alternative in which the underlying base voice or custom voice is changed. Steps 514 and 516 represent the user choosing to hear the waveform in its current state, including as part of the overall editing process.

Step 518 represents the user completing the creation, selection and/or editing processes, with step 520 representing the service outputting the waveform over some channel, such as a .wav file downloaded to the user over the Internet, such as for directly or indirectly embedding into a software program. Again, note that step 518 may correspond to a "cancel" type of operation in which the user does not save the name card or have any waveform output thereto, however such logic is omitted from FIG. 5 for purposes of brevity.

In this manner, there is provided a voice persona service that makes text-to-speech easily understood and accessible for virtually any user, whereby users may embed speech content into software programs, including web applications. Moreover, via the service platform, the voice persona-centric architecture allows users to access, customize, and exchange voice personas.

Exemplary Operating Environment

Figure 6:
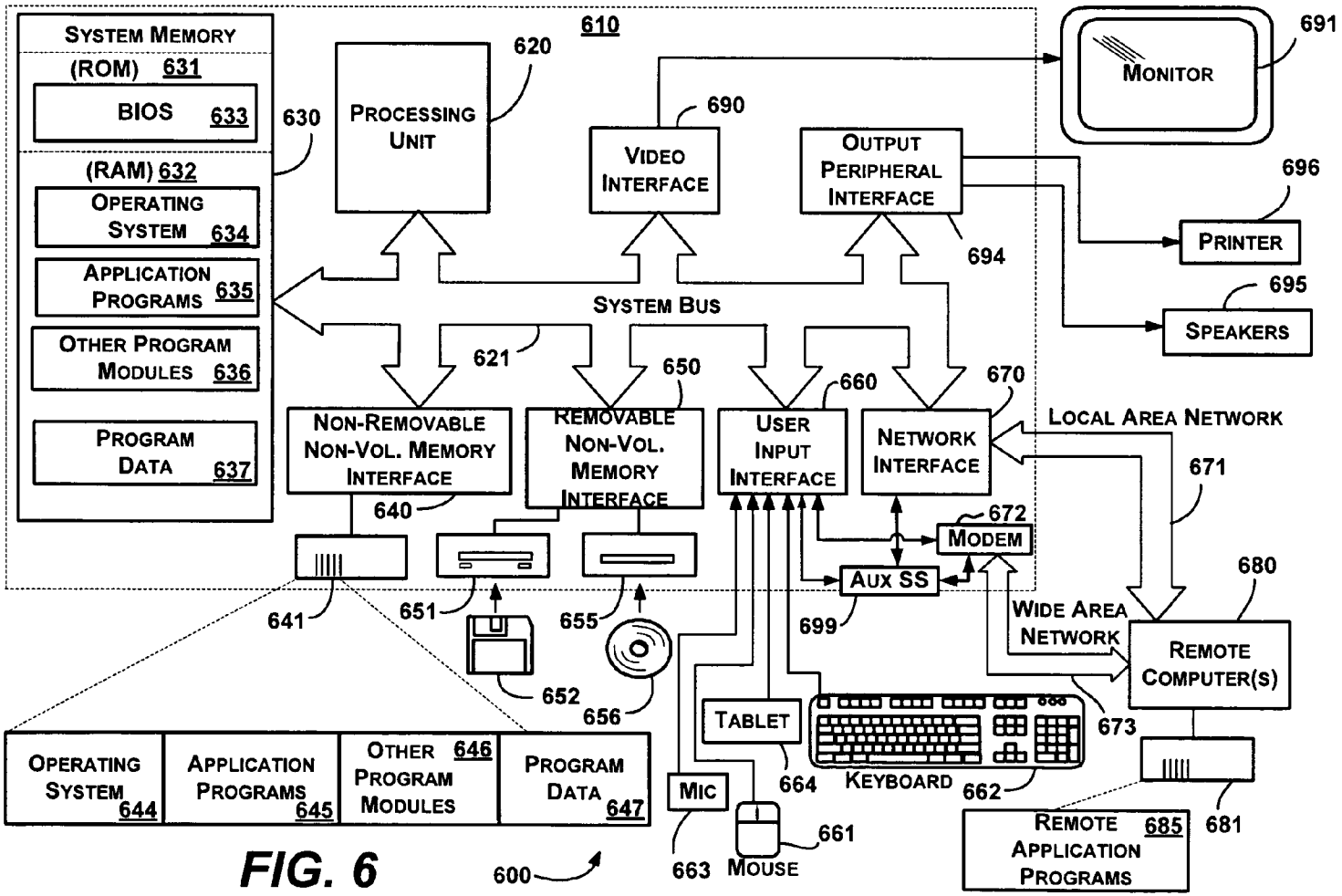
FIG. 6 shows an illustrative example of a general-purpose network computing environment into which various aspects of the present invention may be incorporated.

FIG. 6 illustrates an example of a suitable computing system environment 600 on which the example architectures of FIGS. 1 and/or 2 may be implemented. The computing system environment 600 is only one example of a suitable computing environment and is not intended to suggest any limitation as to the scope of use or functionality of the invention. Neither should the computing environment 600 be interpreted as having any dependency or requirement relating to any one or combination of components illustrated in the exemplary operating environment 600.

The invention is operational with numerous other general purpose or special purpose computing system environments or configurations. Examples of well known computing systems, environments, and/or configurations that may be suitable for use with the invention include, but are not limited to: personal computers, server computers, hand-held or laptop devices, tablet devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, and so forth, which perform particular tasks or implement particular abstract data types. The invention may also be practiced in distributed computing environments where tasks are performed by remote processing devices that are linked through a communications network. In a distributed computing environment, program modules may be located in local and/or remote computer storage media including memory storage devices.

With reference to FIG. 6, an exemplary system for implementing various aspects of the invention may include a general purpose computing device in the form of a computer 610. Components of the computer 610 may include, but are not limited to, a processing unit 620, a system memory 630, and a system bus 621 that couples various system components including the system memory to the processing unit 620. The system bus 621 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

The computer 610 typically includes a variety of computer-readable media. Computer-readable media can be any available media that can be accessed by the computer 610 and includes both volatile and nonvolatile media, and removable and non-removable media. By way of example, and not limitation, computer-readable media may comprise computer storage media and communication media. Computer storage media includes volatile and nonvolatile, removable and non-removable media implemented in any method or technology for storage of information such as computer-readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can accessed by the computer 610. Communication media typically embodies computer-readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer-readable media.

The system memory 630 includes computer storage media in the form of volatile and/or nonvolatile memory such as read only memory (ROM) 631 and random access memory (RAM) 632. A basic input/output system 633 (BIOS), containing the basic routines that help to transfer information between elements within computer 610, such as during start-up, is typically stored in ROM 631. RAM 632 typically contains data and/or program modules that are immediately accessible to and/or presently being operated on by processing unit 620. By way of example, and not limitation, FIG. 6 illustrates operating system 634, application programs 635, other program modules 636 and program data 637.

The computer 610 may also include other removable/non-removable, volatile/nonvolatile computer storage media. By way of example only, FIG. 6 illustrates a hard disk drive 641 that reads from or writes to non-removable, nonvolatile magnetic media, a magnetic disk drive 651 that reads from or writes to a removable, nonvolatile magnetic disk 652, and an optical disk drive 655 that reads from or writes to a removable, nonvolatile optical disk 656 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 641 is typically connected to the system bus 621 through a non-removable memory interface such as interface 640, and magnetic disk drive 651 and optical disk drive 655 are typically connected to the system bus 621 by a removable memory interface, such as interface 650.

The drives and their associated computer storage media, described above and illustrated in FIG. 6, provide storage of computer-readable instructions, data structures, program modules and other data for the computer 610. In FIG. 6, for example, hard disk drive 641 is illustrated as storing operating system 644, application programs 645, other program modules 646 and program data 647. Note that these components can either be the same as or different from operating system 634, application programs 635, other program modules 636, and program data 637. Operating system 644, application programs 645, other program modules 646, and program data 647 are given different numbers herein to illustrate that, at a minimum, they are different copies. A user may enter commands and information into the computer 610 through input devices such as a tablet, or electronic digitizer, 664, a microphone 663, a keyboard 662 and pointing device 661, commonly referred to as mouse, trackball or touch pad. Other input devices not shown in FIG. 6 may include a joystick, game pad, satellite dish, scanner, or the like. These and other input devices are often connected to the processing unit 620 through a user input interface 660 that is coupled to the system bus, but may be connected by other interface and bus structures, such as a parallel port, game port or a universal serial bus (USB). A monitor 691 or other type of display device is also connected to the system bus 621 via an interface, such as a video interface 690. The monitor 691 may also be integrated with a touch-screen panel or the like. Note that the monitor and/or touch screen panel can be physically coupled to a housing in which the computing device 610 is incorporated, such as in a tablet-type personal computer. In addition, computers such as the computing device 610 may also include other peripheral output devices such as speakers 695 and printer 696, which may be connected through an output peripheral interface 694 or the like.

The computer 610 may operate in a networked environment using logical connections to one or more remote computers, such as a remote computer 680. The remote computer 680 may be a personal computer, a server, a router, a network PC, a peer device or other common network node, and typically includes many or all of the elements described above relative to the computer 610, although only a memory storage device 681 has been illustrated in FIG. 6. The logical connections depicted in FIG. 6 include one or more local area networks (LAN) 671 and one or more wide area networks (WAN) 673, but may also include other networks. Such networking environments are commonplace in offices, enterprise-wide computer networks, intranets and the Internet.

When used in a LAN networking environment, the computer 610 is connected to the LAN 671 through a network interface or adapter 670. When used in a WAN networking environment, the computer 610 typically includes a modem 672 or other means for establishing communications over the WAN 673, such as the Internet. The modem 672, which may be internal or external, may be connected to the system bus 621 via the user input interface 660 or other appropriate mechanism. A wireless networking component 674 such as comprising an interface and antenna may be coupled through a suitable device such as an access point or peer computer to a WAN or LAN. In a networked environment, program modules depicted relative to the computer 610, or portions thereof, may be stored in the remote memory storage device. By way of example, and not limitation, FIG. 6 illustrates remote application programs 685 as residing on memory device 681. It may be appreciated that the network connections shown are exemplary and other means of establishing a communications link between the computers may be used.

An auxiliary subsystem 699 (e.g., for auxiliary display of content) may be connected via the user interface 660 to allow data such as program content, system status and event notifications to be provided to the user, even if the main portions of the computer system are in a low power state. The auxiliary subsystem 699 may be connected to the modem 672 and/or network interface 670 to allow communication between these systems while the main processing unit 620 is in a low power state.

CONCLUSION

While the invention is susceptible to various modifications and alternative constructions, certain illustrated embodiments thereof are shown in the drawings and have been described above in detail. It should be understood, however, that there is no intention to limit the invention to the specific forms disclosed, but on the contrary, the intention is to cover all modifications, alternative constructions, and equivalents falling within the spirit and scope of the invention.

What is claimed is:

1. In a computing environment, a system comprising, a service that includes a user interface accessible to clients via a network, a text-to-speech engine, and a data store of user-defined voice personas, a user-defined voice persona specifying one of a plurality of base voices and a plurality of voice morphing parameters associated with the base voice, the service configured to receive definitions of the voice personas from users and store the user-defined voice personas in the store of voice personas, where the users use the user interface to input new voice morphing parameters to modify the morphing parameters of the voice personas, the service configured to obtain via the network a user-provided text-to-speech input script comprised of portions of text comprised of respective voice persona identifiers, each voice persona identifier identifying one of the user-defined voice personas including a voice persona having the voice morphing parameters modified by the new voice morphing parameters inputted through the user interface, and the service converting the text-to-speech input script to a speech waveform via a text-to-speech engine based on the identified user-defined voice personas in the data store of voice personas, where portions of text in the text-to-speech script are converted to speech portions of the speech waveform using the user-defined voice personas identified by the voice persona identifiers, respectively.

2. The system of claim 1 further comprising a voice morphing engine that modifies the speech portions based on the morphing parameters of the identified voice personas.

3. The system of claim 1 herein the service allows users to share user-defined voice personas with other users via the network.

4. The system of claim 1 wherein the voice persona identifiers comprise tags embedded in the user input text-to-speech script.

5. The system of claim 4 wherein at least one tag comprises an XML-based tag that describes a characteristic of the identified voice persona.

6. The system of claim 1 wherein service receives user-provided binary audio speech data, and the service creates and stores a personal base voice from the user-provided binary audio speech data, the personal base voice being available to be specified as a base voice for a user defined voice persona.

7. A computer-readable storage medium having computer-executable instructions, which when executed perform steps, comprising:

storing a plurality of voice personas in a data store, each voice persona comprising a base voice and voice morphing parameters, the voice personas accessible to clients from a voice persona service via a network;

receiving at the voice persona service, via the network, user input identifying one of the stored voice personas and the user input comprising voice morphing parameters; retrieving the base voice and the voice morphing parameters of the voice persona identified by the user input;

modifying the retrieved voice morphing parameters of the voice persona based on the received voice morphing parameters inputted by the user;

saving the modified voice persona in the data store as a new voice persona; and receiving text from a user via the network at the voice persona service, retrieving the new voice persona and outputting a waveform corresponding to the voice persona by performing text-to-speech conversion and speech morphing using the modified morphing parameters.

8. The computer-readable storage medium of claim 7 having further computer-executable instructions comprising, receiving the morphing parameters in an editing operation that modifies, the morphing parameters in the voice persona identified by the user input.

9. The computer-readable storage medium of claim 7 having further computer-executable instructions comprising, at the service, playing the waveform.

10. The computer-readable storage medium of claim 7 wherein outputting the waveform comprises downloading an audio file to a user.

11. The computer-readable storage medium of claim 7 wherein the text comprises tagged text which includes the text and a tag accompanying the text, and parsing the tagged text to send the text to a speech-to-text engine to generate the waveform and to apply a morphing algorithm to the waveform based on the tag.

12. The computer-readable storage medium of claim 7 wherein the user input comprises speech and text corresponding to the speech, and wherein saving the parameter data in a voice persona comprises saving the text in a name card and saving the speech and text in association with a script.

13. A computer-implemented method for a network service allowing users to create and use voice personas in a text-to-speech system, the method comprising:

maintaining a database of voice persona records, each voice persona record specifying an identifier of a voice persona, a base voice of the voice persona, and a plurality of voice morphing parameters of the voice persona;

receiving from clients, via a network, specifications for voice persona records, the specifications comprising voice morphing parameters inputted by users, and in response modifying or creating voice persona records in the database that have the voice morphing parameters by modifying the voice persona records with the voice morphing parameters inputted by the users;

receiving from clients, via the network, text-to-speech scripts, a text-to-speech script comprising portions of text and identifiers identifying voice personas that have the voice morphing parameters received from the clients, and in response:

using the identifiers to retrieve corresponding voice persona records identified by the identifiers, for each retrieved voice persona record, given such a retrieved voice persona record, performing text-to-speech conversion on a corresponding portion of text in the text-to-speech script using the base voice specified by the given voice and morphing the base voice according to the voice morphing parameters specified by the given voice persona record, the conversions of the portions together producing an audio speech data unit comprised of portions of audio speech data of the text portions in voice according to the respective voice persona records.

14. A method according to claim 13 further comprising providing a user interface including one or more interfaces by which a user interacts with the network service to generate a waveform from voice data persisted via a data access mechanism and from a speech-to-text engine, and to modify the waveform with at least one morphing algorithm.

15. A method according to claim 14, wherein the user interface includes a voice persona creation interface, a voice persona management interface, or a voice persona employment interface, or any combination of a voice persona creation interface, a voice persona management interface, or a voice persona employment interface; wherein the network service includes a voice persona parser, a voice persona creation mechanism or a voice persona implementation mechanism, or any combination of a voice persona parser, a voice persona creation mechanism, or a voice persona implementation mechanism; and wherein the data access mechanism includes a base voice persona data store and a voice persona collection data store.

16. A method according to claim 13, further comprising persisting a voice persona corresponding to the waveform, and sharing the voice persona.

17. A method according to claim 13, wherein the speech-to-text conversion uses a hidden Markov model-based system, and wherein the morphing is performed using a sinusoidal model based morphing algorithm, a source-filter model based morphing algorithm, or a phonetic transition morphing algorithm.

18. A computer-implemented method according to claim 13, wherein the text-to-speech conversion comprises automatically selecting a text-to-speech engine from among a plurality of text-to-speech engines.

* * * * *

UNITED STATES PATENT AND TRADEMARK OFFICE

CERTIFICATE OF CORRECTION

PATENT NO. : 7,689,421 B2
APPLICATION NO. : 11/823169
DATED : March 30, 2010
INVENTOR(S) : Yusheng Li et al.

It is certified that error appears in the above-identified patent and that said Letters Patent is hereby corrected as shown below:

In column 13, line 23, in Claim 3, delete "herein" and insert -- wherein --, therefor.

In column 13, line 33, in Claim 6, after "wherein" insert -- the --.

In column 13, line 37, in Claim 6, delete "user defined" and insert -- user-defined --, therefor.

In column 13, line 66, in Claim 8, after "modifies" delete ",".

In columns 15-16, lines 9 and 1, in Claim 17, delete "sinusoidal model" and insert -- sinusoidal-model --, therefor.

Signed and Sealed this
Seventeenth Day of May, 2011

David J. Kappos

David J. Kappos
*Director of the United States Patent and Trademark Office*